US010924829B2

(12) United States Patent
Wu et al.

(10) Patent No.: US 10,924,829 B2
(45) Date of Patent: Feb. 16, 2021

(54) SPEAKER BOX

(71) Applicant: AAC Technologies Pte. Ltd., Singapore (SG)

(72) Inventors: Jun Wu, Shenzhen (CN); Kaihua Shen, Shenzhen (CN); Wang Sun, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,551

(22) Filed: Jul. 29, 2019

(65) Prior Publication Data

US 2020/0045398 A1 Feb. 6, 2020

(30) Foreign Application Priority Data

Aug. 2, 2018 (CN) ..... 201810871831.4

(51) Int. Cl.
*H04R 1/02* (2006.01)
*H04R 9/06* (2006.01)

(52) U.S. Cl.
CPC ..... *H04R 1/025* (2013.01); *H04R 1/021* (2013.01); *H04R 9/06* (2013.01); *H04R 2400/11* (2013.01); *H04R 2499/11* (2013.01)

(58) Field of Classification Search
CPC ..... H04R 1/025; H04R 9/06; H04R 1/021; H04R 2400/11; H04R 1/02; H04R 1/026; H04R 9/18; H04R 1/023; H04R 1/2892; H04R 1/2807; H04R 2499/11
USPC ..... 381/332, 324, 322, 334–336, 361, 366, 381/374
See application file for complete search history.

(56) References Cited

U.S. PATENT DOCUMENTS 8,259,985 B2 * 9/2012 Yang ..... H04R 1/2842 381/386
9,628,900 B2 * 4/2017 Yang ..... H04R 7/18
2009/0190783 A1 * 7/2009 Yang ..... H04R 1/28 381/337
2009/0190788 A1 * 7/2009 Yang ..... H04R 1/2842 381/386
2013/0259284 A1 * 10/2013 Shi ..... H04R 1/025 381/335
2014/0294225 A1 * 10/2014 Ji ..... H04R 1/023 381/386
2016/0119718 A1 * 4/2016 Yang ..... H04R 7/18 381/351

* cited by examiner

*Primary Examiner* — Disler Paul
(74) *Attorney, Agent, or Firm* — W&G Law Group LLP

(57) ABSTRACT

The present disclosure provides a speaker box including a shell, a speaker box, a support wall formed by the inner extension of the shell, and a sound guide channel formed in the receiving space. The speaker is fixed to the support wall. The speaker box includes a surrounding wall formed by the inner extension of the shell and a cover plate arranged on the surrounding wall. The shell, surrounding wall, support wall and cover plate are jointly enclosed as auxiliary sound cavity. The support wall is provided with a through-hole, and the auxiliary sound cavity is communicated with the front cavity through the through-hole to form the resonant cavity structure. The speaker box further includes a leakage to achieve the sound pressure balance inside and outside of the shell. Compared with the related art, the high frequency acoustic performance of the speaker box of the present disclosure is excellent.

6 Claims, 5 Drawing Sheets

SPEAKER BOX

FIELD OF THE DISCLOSURE

The present disclosure relates to acoustic-electro transducers, and more particularly to a speaker box used in a portable electronic device.

DESCRIPTION OF RELATED ART

With the arrival of the mobile internet era, the number of smart mobile devices is being increasing. However, in all these mobile devices, mobile phones are the most common and portable mobile terminal deices. At present, mobile phones are powerful functionality, and one of the powerful functions is the high-quality music function. Therefore, speaker boxes for playing music are widely applied to conventional smart mobile devices.

A speaker box of the related art comprises a shell having a receiving space, a speaker accommodated in the shell and a sound guiding channel defined in the receiving space. The speaker comprises a diaphragm for vibration to produce sound via irradiation, the diaphragm partitions the receiving space into a front sound cavity and a rear cavity. The sound guiding channel communicates the front sound cavity with the outside, and cooperatively defines a front cavity with the front sound cavity.

However, in the speaker box of the related art, the space of the front cavity is limited to a region rightly opposite to a dome and a region of the sound guiding channel, and the structure is monotonous and may not be optimized. Therefore, high-frequency acoustic performance of the speaker box is subject to restrictions, and over-high high-frequency responses may cause harsh sounds, sharp dentilabial sounds and the like poor sound effects.

Therefore, it is desired to provide a speaker box to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
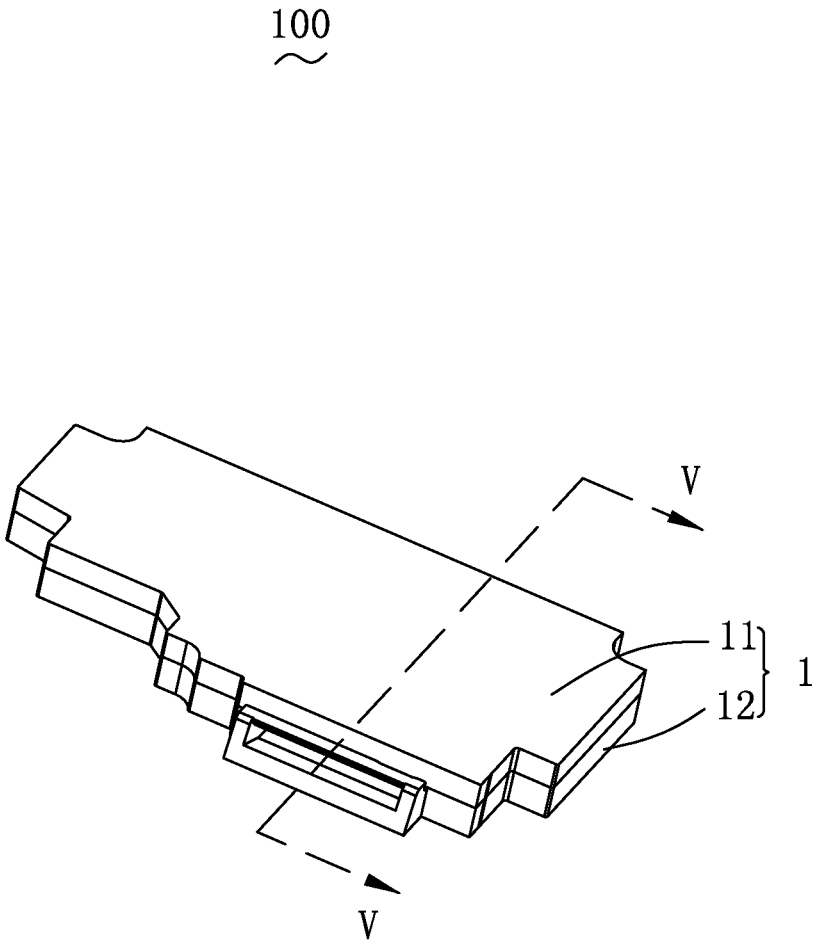
FIG. 1 is a schematic diagram of a three-dimensional structure of the speaker box in accordance with an exemplary embodiment of the present disclosure.
Figure 2:
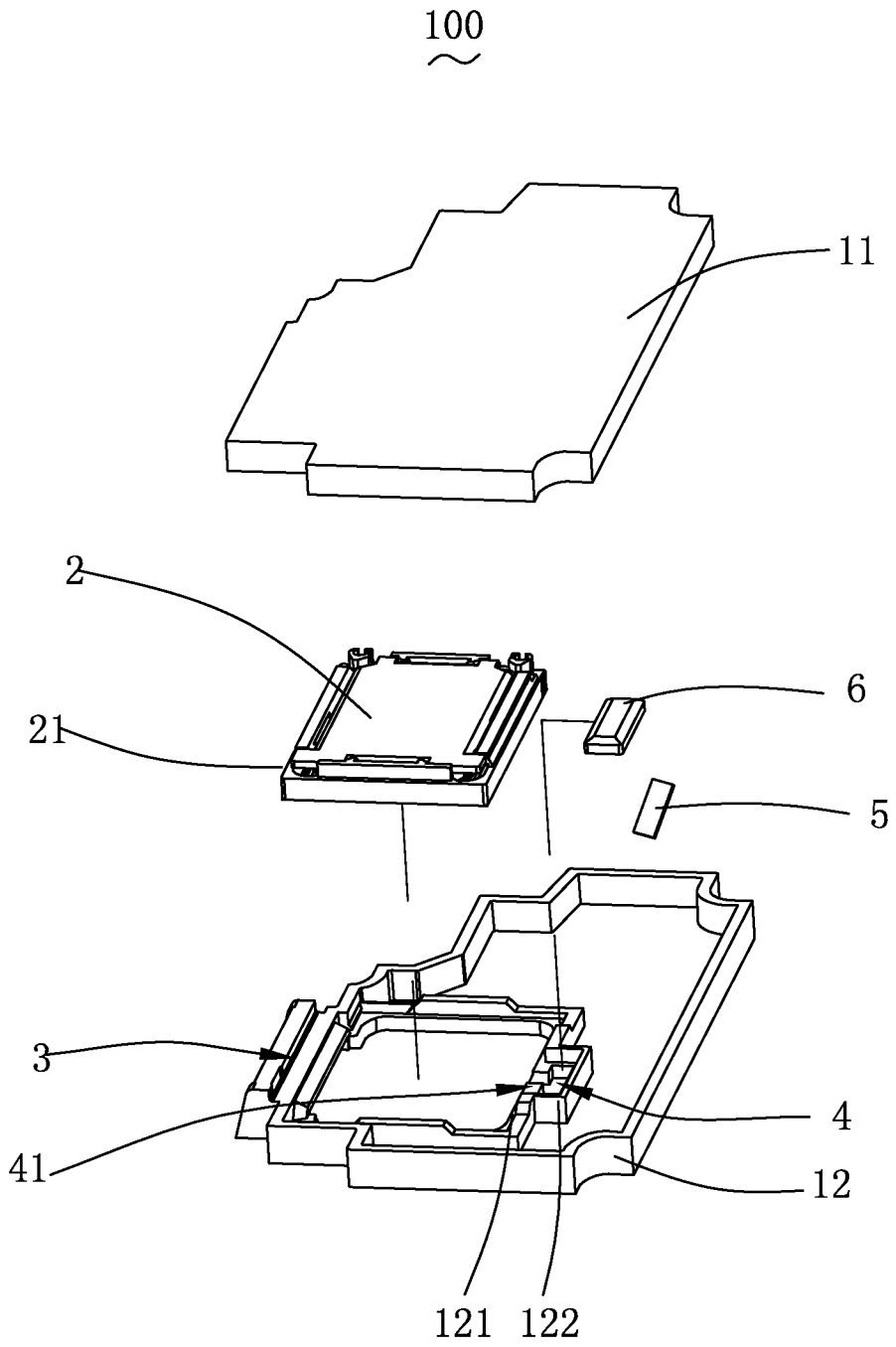
FIG. 2 is a schematic diagram of the structure of the speaker box exploded view showing in FIG. 1.
Figure 3:
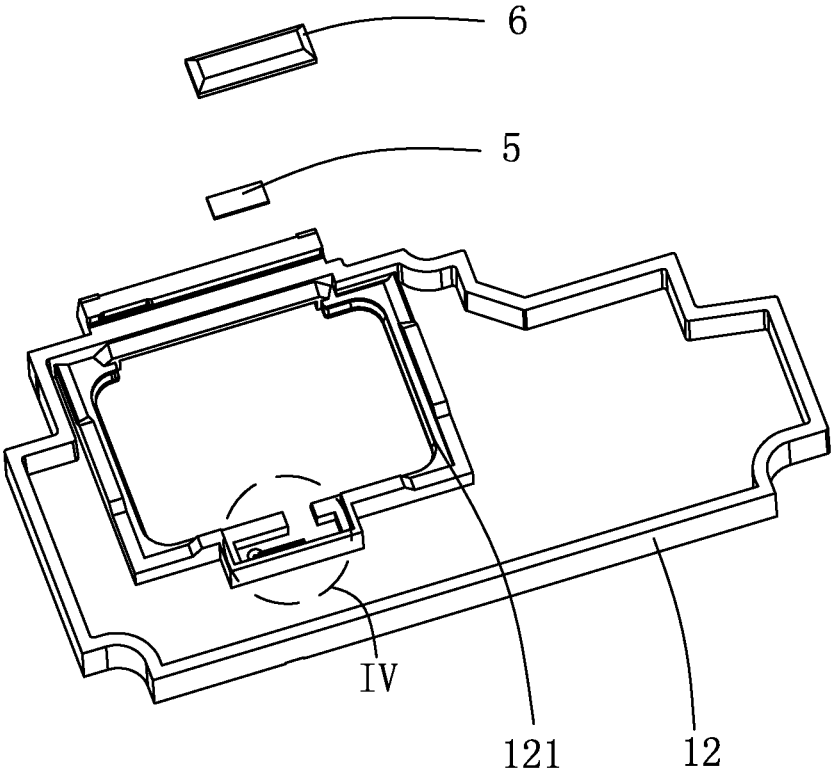
FIG. 3 is a schematic diagram of a partial three-dimensional structure of the speaker box showing in FIG. 1.
Figure 4:
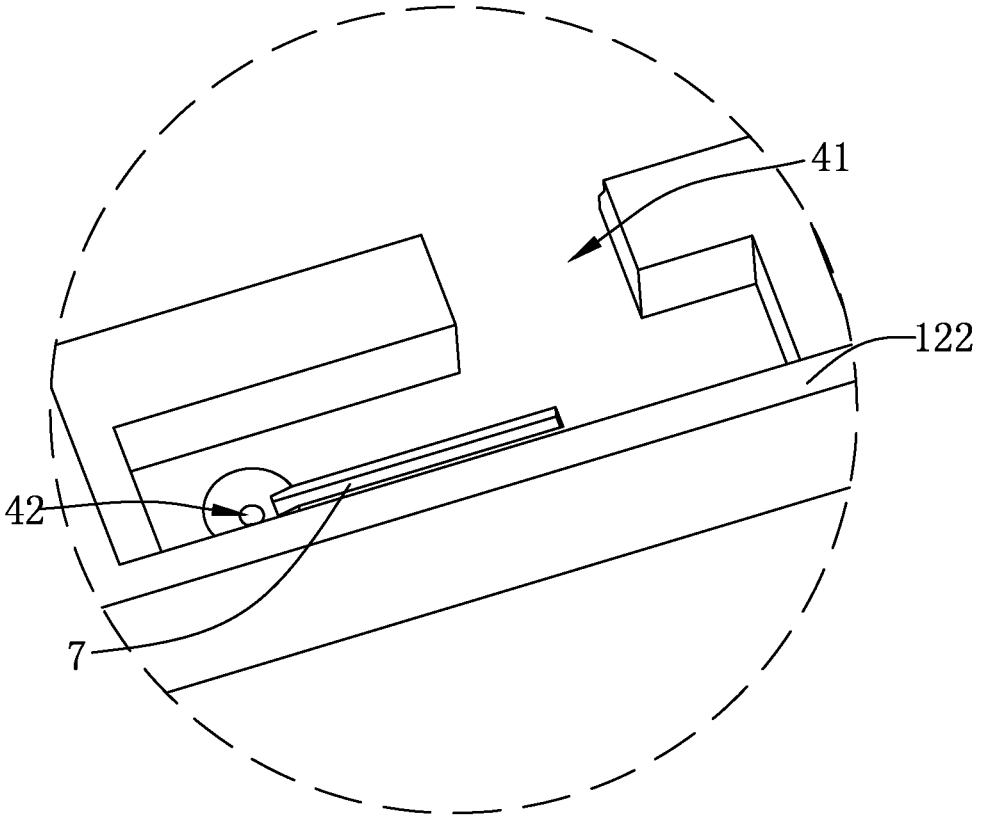
FIG. 4 is a partial enlarged view of the IV area showing in FIG. 3.
Figure 5:
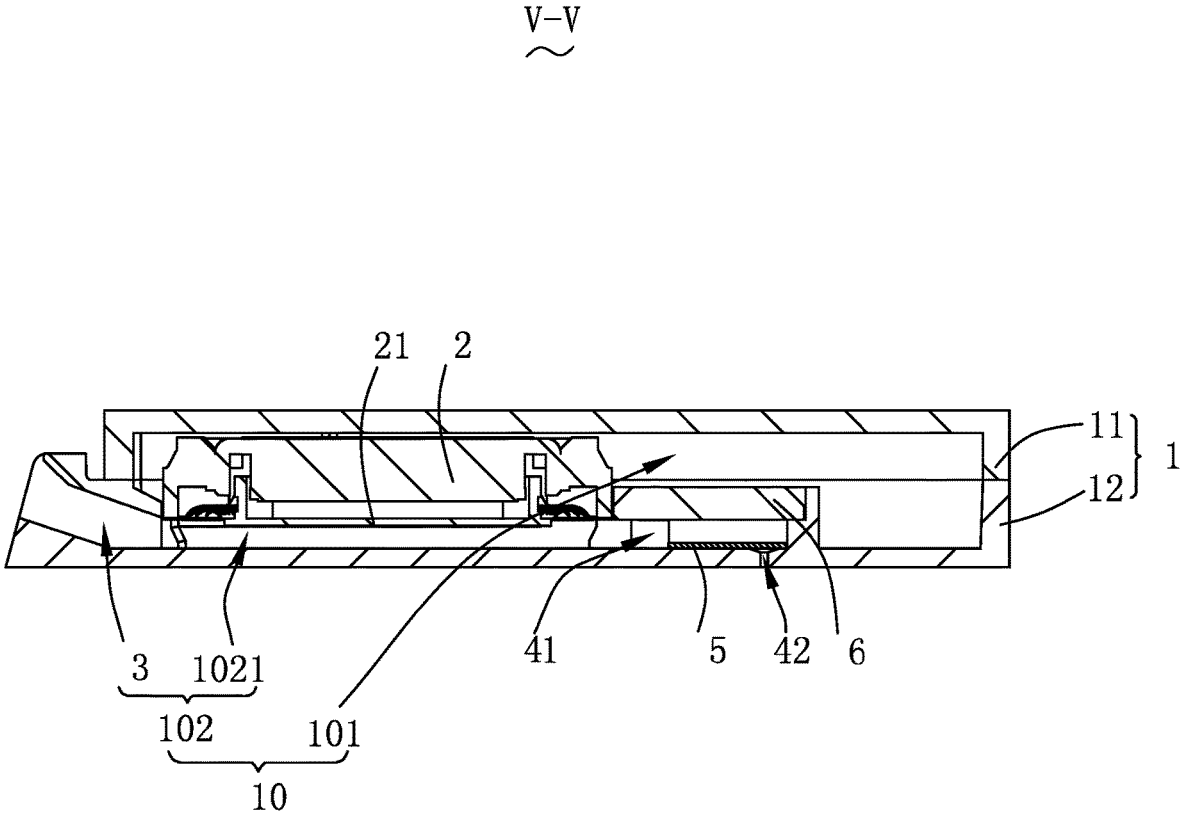
FIG. 5 is a cross-sectional view along the V-V line showing in FIG. 1.

Please also refer to FIG. 1 to FIG. 5, wherein FIG. 1 is a three-dimensional structure diagram of the speaker box of the present disclosure, FIG. 2 is schematic exploded perspective view of the speaker box of the present disclosure, FIG. 3 is a schematic exploded view of a partial three-dimensional structure of a speaker box showing in FIG. 2, FIG. 4 is a partial enlarged view of the IV area shown in FIG. 3, and FIG. 5 is a cross-sectional view taken along line V-V of FIG. 1.

The present disclosure provides a speaker box 100, which comprises a shell 1 having receiving space 10, a speaker 2, a sound guiding channel 3, an auxiliary sound cavity 4, a cover film 5, a cover plate 6 and a guiding groove 7.

The shell 1 may be formed integrally or be formed separately. For example, in this embodiment, the housing 1 includes a lower cover 11, and an upper cover 12 covering with the lower cover 11 and cooperatively defining the receiving space 10 with the lower cover 11.

The speaker 2 is accommodated in the receiving space 10 of the Shell 1, and the speaker 2 partitions the receiving space 10 into a front sound cavity 1021 and a rear cavity 101.

The shell 1 comprises a support wall 121 and a surrounding wall 122. The support wall 121 and the surrounding wall 122 are formed on the upper cover 12. The speaker 2 is supported by the support wall 121 and encloses a front cavity 102 with the upper cover 12.

In this embodiment, the speaker 2 comprises a diaphragm 21 for producing sound via vibration, and the diaphragm 21 partitions the receiving space 10 into the front sound cavity 1021 and the rear cavity 101. In particular, the diaphragm 21 is set at intervals with the upper cover 12 to form the front sound cavity 1021, and the diaphragm 21 is jointly enclosed the rear cavity 101 with the lower cover 11 and the upper cover 12. The rear cavity 101 is used to improve the low frequency acoustic performance of the speaker box 100.

The support wall 121 is for supporting and fixing the speaker 2. The support wall 121 is formed by the inner extension of the shell 1. The surrounding wall 122 is located on the outer side of the support wall 121, and the surrounding wall 122 is formed by the inner extension of the shell 1.

In particular, the Shell 1, the surrounding wall 122, the support wall 121 and the cover plate 6 are jointly enclosed as the auxiliary sound cavity 4.

In this embodiment, a through-hole 41 is disposed through the support wall 121, the auxiliary sound cavity 4 is communicated with the front cavity 102 through the through-hole 41 to form a resonator structure of the front cavity 102, and the sound guiding channel 3 is formed in the receiving space 10 of the shell 1.

The sound guiding channel 3 is formed in the upper cover 12. The sound guiding channel 3 communicates the front sound cavity 1021 with the outside, and the sound guiding channel 3 is cooperates together with the front sound cavity 1021 to form the front cavity 102. The sound guiding channel 3 is used to form a side sound structure of the front cavity 102.

The auxiliary acoustic cavity 4 communicates with the front cavity 102 through the through-hole 41. The speaker box 100 further comprises a leakage structure including a leakage hole 42 through the shell 1.

In the present embodiment, the speaker 2 partitions the front cavity 102 from the auxiliary sound cavity 4 into two cavities, and allows the auxiliary sound cavity 4 to be communicated with the front cavity 102 through the through-hole 41, that is, the auxiliary sound cavity 4 serves as a part of the front cavity 102, and the auxiliary sound cavity 4 is used as a resonant cavity of the front cavity 102. On the one hand, the aforementioned structure effectively increases the volume of the cavity of the front cavity 102 and improves the high-frequency acoustic performance, and on the other hand, the aforementioned structure design of the auxiliary sound cavity 4 is more flexible and diverse, and the restriction is small and the applicability is higher.

Specifically, the auxiliary sound cavity 4 is communicated with the front sound cavity 1021 through the through-hole 41. Of course, the auxiliary sound cavity 4 can also be communicated with the sound guiding channel 3 through the through-hole 41, which is also possible, and the principle is the same.

The speaker 2 is fixed to the support wall 121 by glue bonding, the method makes the whole structure of the speaker 2 combined with the support wall 121 stronger.

In this embodiment, the auxiliary sound cavity 4 further comprises a guiding groove 7, and the auxiliary sound cavity 4 is provided with the guiding groove 7 communicated with the leakage hole 42 and the cover film 5 located in the auxiliary sound cavity 4, and the cover film 5 covers the leakage hole 42 and the part of the guiding groove 7.

The structure can well concentrate the airflow on the guiding groove 7 and lead to the leakage hole 42, which is easy to adjust the leakage airflow to achieve the sound pressure balance inside and outside of the shell 1.

The cover film 5 is made of a PET material, which has higher impact strength and folding resistance than the related materials, and is more hygienic and safe. The cover film 5 is disposed on the side of the leakage hole 42 away from the front cavity 102. This structure can greatly increase the volume of the front cavity 102 under the same conditions to a greater extent to improve its high frequency acoustic performance.

The cover plate 6 is disposed on the surrounding wall 122 and is fixed to the surrounding wall 122, so that the auxiliary sound cavity 4 forms a sealed cavity structure for charging the cavity of the front cavity 102 to realize high-frequency acoustic performance adjustment of the front cavity 102. The cover plate 6 is made of a PET material, the PET material has higher impact strength and folding resistance than the related materials, and the sanitary safety is better. The structure of the auxiliary sound cavity 4 can effectively reduce the Q value of the high frequency resonance peak of the speaker box (quality factor value) and sensitivity make the acoustic performance of the speaker box 100 better.

Compared with the relevant art, the speaker box 100 of the present invention forms an auxiliary sound cavity 4 communicating with the front cavity 102 in the receiving space 10, so that the auxiliary sound cavity 4 acts as a part of the front cavity 102 and acts as a resonant cavity, on the one hand, the aforementioned structure effectively increases the volume of the cavity of the front cavity, and improves High-frequency acoustic performance, on the other hand, the auxiliary sound cavity structure design is more flexible and diverse, and the applicability is higher. The above structure can effectively reduce the Q value (quality factor value) and sensitivity of the high-frequency resonance peak of the speaker box, so that the acoustic performance of the speaker box better.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a shell having a receiving space;

a support wall, which is formed by extending from the inner side of the shell;

a speaker, which is accommodated in the receiving space of the shell and is fixedly supported by the support wall; wherein the speaker comprises a diaphragm for producing sound via vibration, which partitions the receiving space into a front sound cavity and a rear cavity;

a sound guiding channel, which is formed in the receiving space and communicates the front sound cavity with the outside and cooperates with the front sound cavity to form a front cavity;

a surrounding wall, which is formed by extending from the inner side of the shell and is located outside the support wall;

a cover plate, which covers the surrounding wall, and the shell, the surrounding wall, the support wall and the cover plate collectively enclose an auxiliary sound cavity;

wherein the support wall comprises a through-hole, and the auxiliary sound cavity communicates with the front cavity through the through-hole to form a resonant cavity structure of the front cavity; and, wherein the speaker box further comprises a leakage structure for balancing the auxiliary sound cavity with external sound pressure, which comprises a leakage hole extending through the shell, a guiding groove communicating with the leakage hole and a cover film located in the auxiliary sound cavity, the cover film covers the leakage hole and part of the guiding groove.

2. The speaker box as described in claim 1, wherein the cover film is made of PET.

3. The speaker box as described in claim 1, wherein the auxiliary sound cavity communicates with the front sound cavity through the through-hole.

4. The speaker box as described in claim 1, wherein the shell include an upper cover and a lower cover forming the receiving space with the upper cover, the support wall and the surrounding wall are formed on the upper cover, and the speaker is supported on the support wall and encloses the front sound cavity with the upper cover.

5. The speaker box as described in claim 1, wherein the speaker is fixed to the support wall by glue bonding.

6. The speaker box as described in claim 1, wherein the cover plate is made of PET.

* * * * *